US010858765B2

(12) United States Patent
Meier et al.

(10) Patent No.: US 10,858,765 B2
(45) Date of Patent: Dec. 8, 2020

(54) WORK STATION OF A TEXTILE MACHINE, PNEUMATIC THREAD STORAGE ELEMENT FOR A WORK STATION OF A TEXTILE MACHINE AND A TEXTILE MACHINE

(71) Applicant: Maschinenfabrik Rieter AG, Winterthur (CH)

(72) Inventors: Thomas-Georg Meier, Wettstetten (DE); Robert Hagl, Rottenegg (DE); Thomas Gruber, Ingolstadt (DE); Lubomir Molacek, Usti nad Orlici (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 197 days.

(21) Appl. No.: 15/787,133

(22) Filed: Oct. 18, 2017

(65) Prior Publication Data

US 2018/0112334 A1 Apr. 26, 2018

(30) Foreign Application Priority Data

Oct. 20, 2016 (DE) ..... 10 2016 119 983

(51) Int. Cl.
*B65H 51/20* (2006.01)
*D01H 7/00* (2006.01)
(Continued)

(52) U.S. Cl.
CPC ..... *D01H 7/00* (2013.01); *B65H 57/00* (2013.01); *D01H 4/08* (2013.01); *D01H 13/04* (2013.01)

(58) Field of Classification Search
CPC .... B65H 51/20; B65H 51/205; B65H 67/085; D01H 13/104
See application file for complete search history.

(56) References Cited

U.S. PATENT DOCUMENTS 3,198,446 A * 8/1965 Furst ..... B65H 67/081 242/475.6
4,121,409 A * 10/1978 Uchida ..... B65H 51/205 57/22

(Continued)

FOREIGN PATENT DOCUMENTS

DE 28 02 913 B1 11/1978
DE 29 39 644 A1 4/1981

(Continued)

OTHER PUBLICATIONS

German Patent Office Search Report, dated Jun. 29, 2017.
EPO Search Report, dated Mar. 19, 2018.

*Primary Examiner* — Tajash D Patel
(74) *Attorney, Agent, or Firm* — Dority & Manning, P.A.

(57) ABSTRACT

A work station of a textile machine includes a plurality of fiber-guiding work elements that are divided into at least two groups. A first work station part is defined at the work station on which a first group of the fiber-guiding work elements is arranged. A second work station part is defined at the work station on which a second group of the fiber-guiding work elements is arranged. The second work station part is arranged in a movable manner relative to the first work station part at the work station or is arranged in a removable manner at the work station. A pneumatic thread storage element is also provided for a work station of a textile machine for the temporary receiving of a thread, and includes a multi-part structure with a first thread storage section and a second thread storage section connected to one another at a separation point.

15 Claims, 3 Drawing Sheets

(51) Int. Cl.

| | |
|---|---|
| ***B65H 57/00*** | (2006.01) |
| ***D01H 13/04*** | (2006.01) |
| ***D01H 4/08*** | (2006.01) |

(56) References Cited

U.S. PATENT DOCUMENTS

| | | | |
|---|---|---|---|
| 4,223,518 | A | 9/1980 | Karl et al. |
| 4,356,692 | A | 11/1982 | Karl et al. |
| 4,967,549 | A | 11/1990 | Lovas et al. |
| 7,681,389 | B2 | 3/2010 | Preutenborbeck et al. |

FOREIGN PATENT DOCUMENTS

| | | | |
|---|---|---|---|
| DE | 38 25 327 | A1 | 2/1990 |
| DE | 10 2006 034228 | A1 | 3/2007 |
| DE | 10 2005 055717 | A1 | 5/2007 |
| DE | 10 2008 050340 | A1 | 4/2010 |
| EP | 2 172 409 | A2 | 4/2010 |
| JP | 2004 107830 | A | 4/2004 |
| JP | 2009 041153 | A | 2/2009 |
| WO | WO 2012/068693 | A1 | 5/2012 |

* cited by examiner

WORK STATION OF A TEXTILE MACHINE, PNEUMATIC THREAD STORAGE ELEMENT FOR A WORK STATION OF A TEXTILE MACHINE AND A TEXTILE MACHINE

FIELD OF THE INVENTION

The present invention relates to a work station of a textile machine, in particular a spinning unit of a spinning machine, with a multiple number of fiber-guiding work elements along with a pneumatic thread storage element for the work station, for the temporary receiving of a thread. The invention also relates to a corresponding textile machine.

BACKGROUND

Textile machines with a multiple number of work stations along with work stations of textile machines with fiber-guiding work elements have been known in the state of the art in various designs. Typically, the individual work elements are fastened to a wall of a frame of the textile machine by means of various brackets. A frame for such a textile machine is described, for example, in DE 10 2006 034 228 A1. Herein, the assembly of the work station or of the textile machine at the location of installation is associated with a large expenditure of time. Likewise, the maintenance of individual work elements is associated with a large expenditure of time, which can lead to undesirable down times of the work station or even of the textile machine.

Pneumatic thread storage elements for textile machines are also known. Such devices are used both for spinning machines, such as rotor, ring, or air spinning machines, and for other textile machines such as winding machines, in order to be able to carry out various work or maintenance processes, with which a thread must be held or temporarily stored. For example, such pneumatic thread storage elements can be used to keep the thread tension constant during the work process of the textile machine, or in the piecing process for rotor spinning machines, in order to be able to maintain and release a required thread length during manipulation with different piecing elements. The thread storage elements detect the thread by means of an applied suction air stream and receive into themselves the required thread quantity. Since it is often the case that relatively large thread quantities have to be stored temporarily, such thread storage elements have a comparatively long length. As such, the assembly of the work stations of the textile machine with the thread storage elements is often complex.

In order to achieve a shorter construction length, thread storage elements have become known that comprise a thread storage chamber in which the thread is placed on a screen surface in a multiple number of loops adjacent to one another. Such a thread storage element is shown, for example, in DE 38 25 327 C2. However, a disadvantage of such thread storage devices is that entanglements of the individual thread loops adjacent to one another can arise, such that the stored thread quantity cannot be released again with sufficient speed, if this is necessary. In addition, such thread storage elements feature a comparatively complex design, and thus also require a large assembly effort on the textile machine. In addition, the cleaning of the thread storage elements can be made more difficult.

SUMMARY OF THE INVENTION

Therefore, it is a task of the present invention to propose a work station of a textile machine along with a pneumatic thread storage element, which simplifies the assembly and the maintenance of the work station. Furthermore, a corresponding textile machine is to be proposed. Additional objects and advantages of the invention will be set forth in part in the following description, or may be obvious from the description, or may be learned through practice of the invention.

The tasks are solved with the characteristics of the invention described and claimed herein.

A work station of a textile machine, in particular a spinning unit of a spinning machine, features a multiple number of fiber-guiding work elements. Within the framework of the present application, fiber-guiding work elements are understood to mean all work elements that, in any manner, handle fibers in the form of fiber material or in the form of an already produced thread. Such work elements in a spinning machine, may be, for example, a feed roller, an opening device, a spinning element, a draw-off device, a waxing device, a yarn monitoring device with a thread monitor and/or a yarn cleaning device, a thread tension compensating bar, a winding roller, or even a thread storage element. It is not absolutely necessary for the work elements, referred to here as fiber-guiding work elements, to actually touch the thread or the fibers.

The multiple number of fiber-guiding work elements is now divided into at least two groups, and the work station features at least one first work station part, on which a first group of the fiber-guiding work elements is arranged, and at least one second work station part, on which a second group of the fiber-guiding work elements is arranged. The second work station part is arranged in a movable manner (in particular, pivotable) relative to the first work station part, and/or the second work station part is arranged in a removable manner at the work station.

In a particularly favorable manner, the division of the work elements into at least two groups makes it possible to carry out extensive pre-assembly of the two work station parts with the groups of fiber-guiding work elements assigned to them in each case. In each case, that is, at each work station of the textile machine, in particular, the second work station part may be fastened in its entirety at the textile machine, in particular on a frame or a frame section of the textile machine. This facilitates the assembly at the location of installation.

According to the first design of the invention, the second work station part is arranged in a manner pivotable in relation to the first work station part. Through such a design, not only is the assembly of the work elements of the work station facilitated; rather, the cleaning and maintenance of the work station, in particular of the work elements arranged behind the second work station part, and other components of the textile machine, are also possible in an easy manner after the pivoting of the second work station part. As an alternative to a pivoting of the second work station part with respect to the first work station part, it is, of course, also conceivable for the second work station part to be arranged in a linear movable manner at the first work station part.

Alternatively or in addition, the second work station part is arranged in a removable manner at the work station. The term "removable" is understood here to be a design that enables a simple and rapid detachment of the second work station part. In the case of a defect of a work element or of a component, this makes it possible to replace the entire second work station part with a new one, by which production can be resumed immediately after replacement. The removed second work station part can then be repaired at rest and later reattached to another work station, which is preferably possible by means of a simple insertion.

Preferably, the second work station part is arranged in a manner at the work station that it is detachable without a tool. However, it is likewise possible to fix the second work station part at the work station, preferably by means of only one single fastening element, for example a screw, in order to avoid undesirable movements, for example, through vibrations of the components and the like.

The first work station part can either be formed directly by the frame or a frame section of the textile machine, whereas the work elements of the first group are then fastened to the frame section directly, if necessary by means of suitable brackets.

However, it is also possible to design the first work station part as a pre-assembled unit, which can be fastened in its entirety to the work station of the textile machine, in particular at a frame or a frame section of the textile machine. Thus, for the purpose of the assembly of the work station at the textile machine, only the first work station part and the second work station part have to be fastened either to one another or independently of one another at the textile machine.

In particular, even if the first work station part forms a pre-assembled unit, it is also advantageous if the second work station part is arranged in a pivotable manner, in particular pivotable upwards, at the first work station part. The upwardly pivotable design makes it easier for an operator or an installer to access the work elements and components of the textile machine arranged behind or below the second work station part. However, depending on the arrangement of the work elements at the individual work station, pivoting downwards may also be advantageous.

It is advantageous if a winding roller is arranged by means of a bracket at the first work station part and the second work station part is arranged at the bracket in a pivotable manner, in particular in a manner pivotable around a rotational axis of the winding roller. Thus, no separate component is necessary for receiving the second work station part. The winding roller is arranged by means of its bracket in a manner spaced from a frame of the textile machine, such that, at the same time, its rotational axis advantageously can serve as the pivot axis of the second work station part.

According to an advantageous additional form of the invention, the first work station part includes a first carrier element, on which at least a part of the fiber-guiding work elements of the first group is arranged. The pre-assembly and the maintenance of the first work station part is thereby facilitated, since the first work station part can be assembled or disassembled in its entirety. However, it is also possible for the first work station part to feature a multiple number of first carrier elements, on each of which a part of the work elements of the first group is arranged and each of which can be fastened separately to the work station.

It is likewise advantageous if the second work station part includes a carrier element, on which the fiber-guiding work elements of the second group are arranged. This not only facilitates the pre-assembly, assembly and disassembly of the second work station part; rather, individual work elements can also be exchanged with particular ease. However, it is also possible for the individual work elements to be fixed directly to one another without a common carrier element, in order to form the second work station part.

If the textile machine producing cross-wound bobbins is formed as a spinning machine, it also features a multiple number of thread-producing work elements in addition to a multiple number of fiber-guiding work elements. The thread-producing work elements are predominantly understood as the work elements that are grouped together in a so-called "spinning box." In the case of a rotor spinning machine, it comprises, for example, the spinning rotor, the draw-off nozzle, if applicable a twist jam element and a draw-off tube, along with an opening unit and a feed unit. Analogous to this, the thread-producing work elements comprise, for example, an air spinning nozzle on an air spinning machine, along with, if applicable, downstream twist elements and draw-off tubes. It is in turn advantageous if all thread-producing elements are arranged at the first work station part. Thus, the thread-producing work elements can be pre-assembled at the first work station part and, if necessary, can also be taken together from the textile machine, in order to maintain or exchange them. On the other hand, most of the fiber-guiding work elements are pre-assembled at the second work station part, and therefore likewise can be simply assembled together at the textile machine or disassembled for maintenance or cleaning purposes.

According to an additional advantageous design of the invention, the work station features a pneumatic thread storage element, in particular a thread storage tube, for the temporary receiving of a thread, and the thread storage element features an at least two-part structure with a first thread storage section and a second thread storage section, which are connected to one another at a separation point. The separation point of the pneumatic thread storage element makes it possible to integrate the thread storage element, at least the second thread storage section, as a fiber-guiding work element into the pre-assembly circumference at least of the second work station part.

Advantageously, the first thread storage section is arranged at the first work station part and the second thread storage section is arranged at the second work station part. As a result of this, in a particularly favorable manner, an extensive pre-assembly of the two work station parts with the respectively assigned thread storage sections is made possible; in each case, this can then be fastened in its entirety to the textile machine, in particular to a frame of the textile machine. Thus, for the purpose of the assembly of the work station at the textile machine, only the first work station part and the second work station part have to be fastened either to one another or independently of one another at the textile machine, whereas, at the same time, the two thread storage sections at the separation point are assembled together at the thread storage element.

A pneumatic thread storage element, in particular a thread storage tube, for a work station of a textile machine, in particular a spinning unit of a spinning machine, for the temporary receiving of a thread therefore features an at least two-part structure. With this, a first thread storage section and a second thread storage section are provided and are connected to one another at a separation point.

According to a first design of the thread storage element, the first thread storage section and the second thread storage section can be completely detached from one another at the separation point. Thereby, the assembly and disassembly of the thread storage element or of the work elements connected to the relevant thread storage section is possible in a particularly simple and flexible manner. At the same time, the cleaning and maintenance of the thread storage element is also facilitated. Thus, for example, the first thread storage section can already be pre-assembled together with the first group of operating elements of the work station, and then, together with them, can be attached as a first work station part at the work station of the textile machine, in particular at a frame section of the textile machine. Alternatively, however, the first thread storage section may also be arranged as a single component directly at the work station. The second thread storage section may be fastened separately from the first thread storage section at the second work station part. If the pre-assembled second work station part is then mounted (in particular, suspended), together with the second thread storage section, which is already attached to it, at the frame of the textile machine, the two thread storage sections can be connected to the thread storage element at the same time. Of course, it is also conceivable for the thread storage element to feature not only a first and a second thread storage section, but also additional thread storage sections. Thereby, the assembly of the thread storage element can be further simplified, since the thread storage element no longer has to be mounted at the textile machine in its entirety. The two-part or multi-part structure of the thread storage element offers an advantage not only upon assembly, but also upon cleaning and maintenance, since all thread storage sections of the thread storage element are readily accessible through the separation point(s). If, in the case of a removable design, the second work station part is removed from the work station, the thread storage sections are simultaneously separated from one another without disassembly work.

However, according to a second embodiment of the thread storage element, the separation point does not have to enable a complete separation of the thread storage sections. Rather, it can also be sufficient if the two thread storage sections are connected to each other in a manner that is movable relative to one another at the separation point. For example, the first thread storage section and the second thread storage section can also be connected to one another in a pivotable manner at the separation point, which is advantageous in the case of a second work station part arranged in a pivotable manner. Given the movability of the two thread storage sections with respect to one another, it is nevertheless possible to combine the thread storage element or a thread storage section of the thread storage element together with other work elements of the work station into a pre-assembly circumference. The other thread storage section, which is connected in a movable manner to the first thread storage section, can then be connected in a simple manner either to a negative pressure channel of the textile machine or to an additional section of the thread storage element that is arranged at the textile machine upon the assembly of the pre-assembly circumference at the textile machine.

Herein, in each case, the described thread storage element with the two-part structure, with a first thread storage section and a second thread storage section, enables a simplified assembly of the work station of the textile machine and the thread storage element itself.

Since, with a textile machine, a multiple number of pneumatic thread storage elements and a multiple number of work stations are to be mounted, the thread storage element and the work station with the two-part structure can advantageously be used in various textile machines. Therefore, a textile machine with such a work station or with such a thread storage element is also claimed.

In order to enable the assembling of the thread storage element from the first thread storage section and the second thread storage section, it is advantageous if one of the two thread storage sections has an extension at its end turned towards the other thread storage section. Thereby, upon the assembly of the two work station parts with one another or at the textile machine, it is possible to, in a simple manner, securely join the two thread storage sections. As such, in the same manner, it can also be advantageous if one of the two thread storage sections features a reduction at its end turned towards the other thread storage section. In principle, however, the two thread storage sections to be joined can also have the same dimensions at the separation point.

BRIEF DESCRIPTION OF THE DRAWINGS

Additional advantages of the invention are described on the basis of the following presented embodiments. The following is shown.

DETAILED DESCRIPTION

Figure 1:
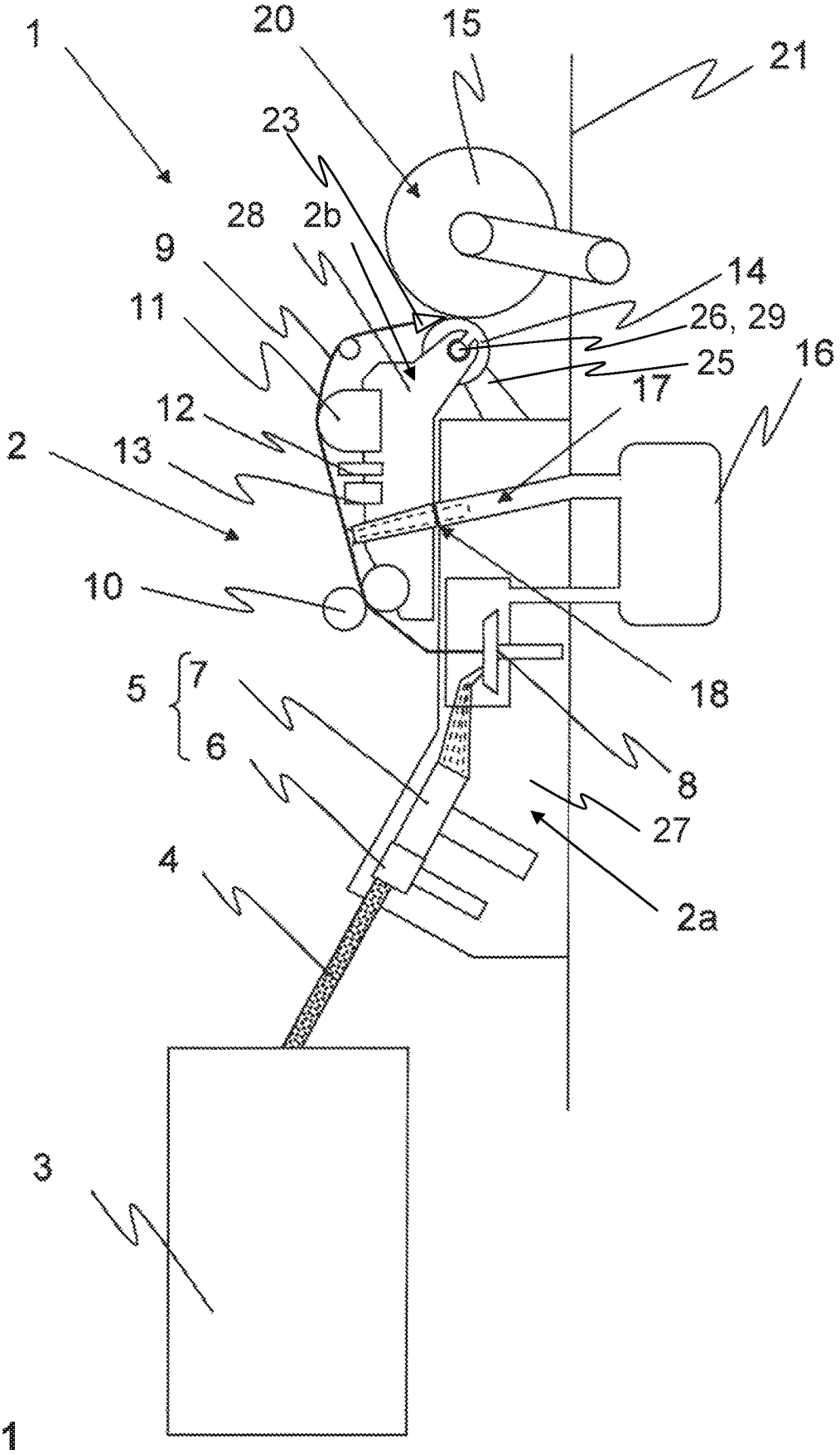
FIG. 1 is a schematic sectional view of a work station of a textile machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following descriptions of the figures, the same reference signs are used for characteristics that are identical and/or at least comparable in their arrangement and/or mode of operation. For the sake of clarity, not all characteristics are shown and indicated in all of the figures. Likewise, some characteristics are not described in all of the figures, but are explained merely by way of example on one of the figures. If characteristics described in the figures are not explained in detail in the accompanying description, their arrangement and/or modes of operation correspond to the arrangement and/or mode of operation of the characteristics described in the other figures.

FIG. 1 shows a work station 2 of a textile machine 1 in a schematic, sectioned side view. A multiple number of fiber-guiding work elements 5, 6, 7, 8, 10, 11, 12, 14, 17, 23, 24 is arranged at the work station 2; by means of such elements, a thread 9 is produced if necessary and, after its production, can be fed to a winding device 20.

The present textile machine 1 is formed as a rotor spinning machine, which features a multiple number of work stations 2 next to one another in one arrangement. In a manner known per se, a fiber material 4 is fed to the work stations 2 from a storage container 3 by way of a feed device 5, which in the present case comprises a feed roller 6 along with an opening device 7. From there, the fiber material 4, which has been separated into its individual fibers, is fed to a spinning element 8, which in the present case is formed as a spinning rotor and in which the fiber material 4 is spun into the thread 9. The produced thread 9 is then drawn off by means of a draw-off device 10 and, through a series of additional fiber-guiding work elements 11, 12, 14, 17, 23, 24, is then fed to the winding device 20 with the winding roller 14 and the cross-wound bobbin 15, on which it is wound by means of a traversing device 23, which is only schematically indicated here. The traversing device 23 includes a traversing thread guide, symbolically presented here, along with a traversing drive (not shown). In the present case, the draw-off device 10, a yarn monitoring device 12, a device for thread tension compensation 13, and with a waxing device 11 are provided as additional fiber-guiding work elements. Likewise, the feed device 5, the feed roller 6, the opening device 7, the spinning element 8, the winding roller 14 and the traversing device 23 form the fiber-guiding work elements 5, 6, 7, 8, 10, 11, 12, 14, 17, 23, 24. However, this enumeration of the fiber-guiding work elements is only to be understood as exemplary. Likewise, additional fiber-guiding work elements 5, 6, 7, 8, 10, 11, 12, 14, 17, 23, 24 or other fiber-guiding work elements 5, 6, 7, 8, 10, 11, 12, 14, 17, 23, 24 could be provided. The yarn monitoring device 12 can also be formed differently, and may contain a thread monitor in the simplest manner or may additionally feature a yarn cleaning device.

Of course, the illustrated design of the textile machine 1 as a rotor spinning machine is only to be understood as exemplary. Likewise, the textile machine could be formed as an air spinning machine, whereas the feed device 5 then includes a drafting unit with delivery rollers, and the spinning element is formed as an air spinning nozzle. Furthermore, the textile machine could also be formed as a ring spinning machine, another spinning machine, or a winding machine. The thread 9 does not necessarily have to be wound on a cross-wound bobbin; rather, it could also be wound onto a yarn cop.

Furthermore, on the textile machine 1 presented here, a negative pressure channel 16 can be seen, which extends in the longitudinal direction of the textile machine 1 along the work stations 2 and to which the individual work stations 2 of the textile machine 1 are connected. In the present case, the negative spinning pressure, which is required for rotor spinning, is also provided by the negative pressure channel 16. With other types of spinning machines and textile machines 1, no negative pressure is required for the spinning process itself or the work process itself. However, as a rule, a multiple number of work elements are present at the work stations 2 of textile machines 1; such elements require negative pressure.

The work station 2 features a two-part structure with a first work station part 2*a* and a second work station part 2*b*. This results in a particularly advantageous structure of a work station 2, which enables a pre-assembly of fiber-guiding work elements 5, 6, 7, 8, 10, 11, 12, 14, 17, 23, 24 at the first work station part 2*a* and at the second work station part 2*b*. For this purpose, the fiber-guiding work elements 5, 6, 7, 8, 10, 11, 12, 14, 17, 23, 24 are divided into at least two groups. As such, the two work station parts 2*a* and 2*b* can be almost completely pre-assembled in a particularly favorable manner and, in a simple manner, are fastened as a pre-assembly circumference to a frame section 21 of the textile machine 1, which is assigned to the respective work station and in the present case is presented only symbolically.

In the present case, the winding roller 7, the feed roller 6, the spinning element 8 and, if applicable, thread-producing work elements (not shown here) are arranged at the first work station part 2*a* as fiber-guiding work elements, in particular thread-producing work elements, as in the present case, of a rotor spinning machine. In addition, in the present case, the winding roller 14 is arranged at the first work station part 2*a*. The specified work elements together form the first group of the fiber-guiding work elements. On the other hand, at the second work station part 2*b*, all of the fiber-guiding work elements that follow the thread-producing work elements (here, including in particular the draw-off device 10) are at least a part of the thread storage element 17, the yarn monitoring device 12, the waxing device 11, and the traversing device 23. Together, they form the second group of the fiber-guiding work elements. Of course, this is also to be understood as only exemplary; here, additional or other fiber-guiding work elements may also be provided, for example a suction nozzle 24 arranged at the work station (see FIGS. 2 and 5).

In the present case, the first work station part 2*a* includes a first carrier element 27, on which the first group of the fiber-guiding work elements is arranged. In the present case, the second work station part 2*b* includes a second carrier element 28 for the second group of the fiber-guiding work elements, which, in a particularly advantageous manner, thereby can be pre-assembled at it in the correct positioning. Here, in the present case, the second work station part 2*b* is arranged in a pivotable manner at the first work station part 2*a*, and as such can be pivoted away for assembly and cleaning purposes in a simple manner.

In the present case, the second work station part 2*b* is arranged in a pivotable manner around a pivot axis 29 on a bracket 25, on which the winding roller 14 is also supported at the same time. Here, in the present case, the second work station part 2*b* can be pivoted around the rotational axis 26 of the winding roller 14, such that the rotational axis 26 and the pivot axis 29 are identical. Of course, the rotational axis 26 and the pivot axis 29 can also be provided spatially separated from each other.

Furthermore, the work station 2 features a pneumatic thread storage element 17, by means of which a thread can be fixed in a manner known per se for different working steps, and a certain thread quantity can be stored temporarily. This storage element 17 also forms a fiber-guiding work element. The loop-shaping sucking in of a thread piece into the thread storage element 17 is indicated here by a dashed line. For example, by means of such pneumatic thread storage elements 17, the thread tension can be kept constant during certain working steps or, for example, a certain thread length can be temporarily stored and released again during the piecing process. In the present case, the thread storage element 17 is formed as a thread storage tube. Since it is often the case that relatively large thread quantities have to be stored temporarily, which quantities have to be released again rapidly and reliably, such thread storage elements 17 often feature comparatively large dimensions, which makes their installation in the textile machine 1 along with the assembly of the various work elements at the work station 2 more difficult. Likewise, the accessibility of the thread storage element 17 for cleaning purposes is often made more difficult. The thread storage element 17 features a two-part structure with a first thread storage section 17*a* and a second thread storage section 17*b*, which are connected to one another at a separation point 18, as will be explained in more detail below.

Figure 2:
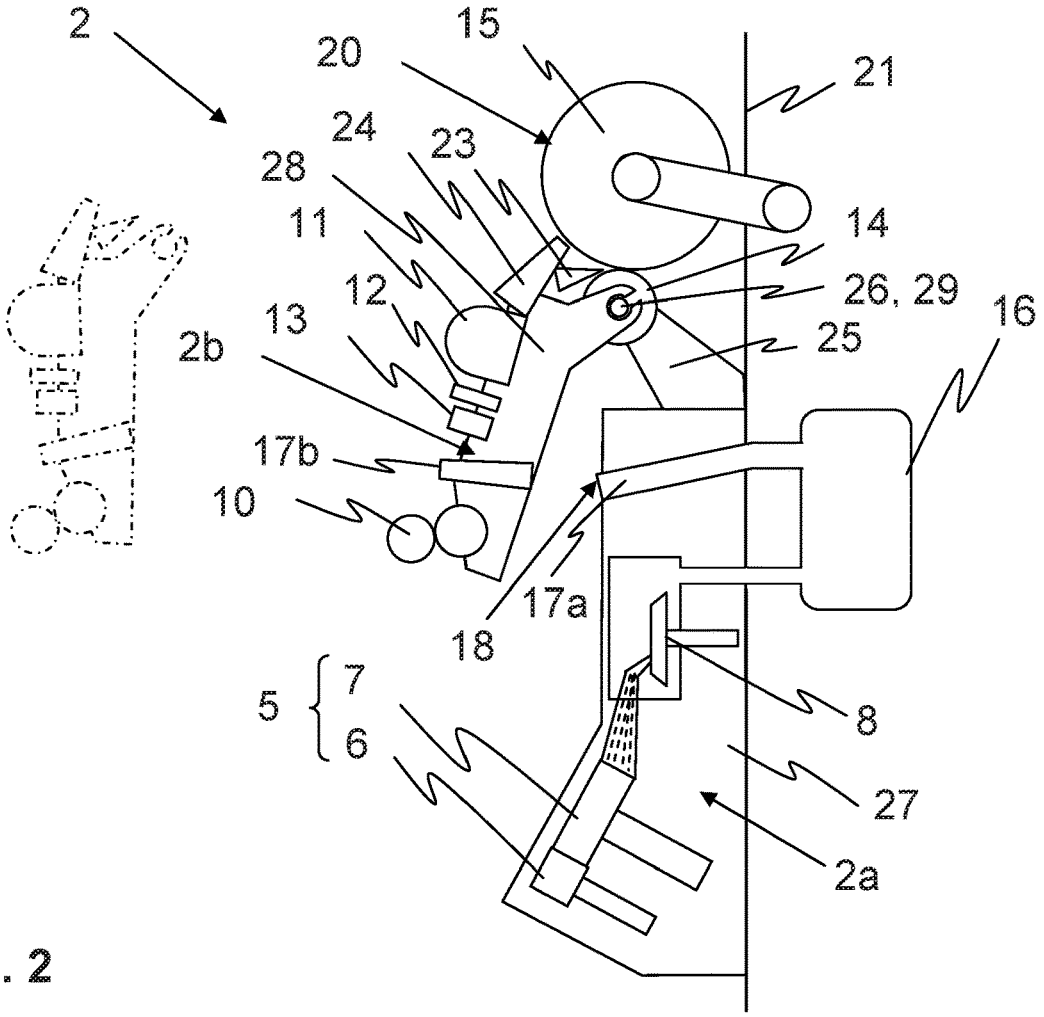
FIG. 2 is a section from the schematic sectional view of FIG. 1, whereas a work station part is pivoted.

Similar to FIG. 1, FIG. 2 shows a schematic sectional view of a work station of a textile machine with a first work station part 2*a* and a pivotable, second work station part 2*b*. Likewise, the thread storage element 17 is structured in two parts. The first thread storage section 17*a* is arranged at the first work station part 2*a* and the second thread storage section 17*b* is arranged at the second work station part 2*b*. If the second work station part 2*b* is then pivoted away from the first work station part 2*a*, for example, for assembly and cleaning purposes, the pneumatic thread storage element 17 is then separated at the separation point 18. In contrast to FIG. 1, in the present case, the work station 2 also features a suction nozzle 24 arranged in a stationary manner at the work station 2, in the present case at the second work station part 2*b*. In the present case, the suction nozzle 24 thus belongs to the second group of fiber-guiding work elements.

Through the formation of the thread storage element 17 with a first thread storage section 17*a* and a second thread storage section 17*b*, a cohesive thread storage element 17 is nevertheless achieved in a simple manner. Herein, upon the assembly of the second work station part 2*b* at the frame section 21 of the textile machine 1 or, if applicable, at the first work station part 2*a*, the second thread storage section 17*b* is also automatically positioned correctly with respect to the first thread storage section 17*a*.

FIG. 2 also shows that, according to an advantageous design of the work station 2, the second work station part 2*b* can be arranged not only in a pivotable manner, but also in a removable manner at the work station 2. For this purpose, as shown in the present case, the carrier element 28 or, if there is no common carrier element 28, another bracket of the work station part 2*b*, can only be inserted into the bracket 25 and, if applicable, fixed to the work station by means of a fastening element (not shown here). Likewise, the carrier element 28 or another bracket could feature a hook-shaped hanging bracket or the like (not shown), by means of which it can be suspended at the work station 2.

Figure 3:
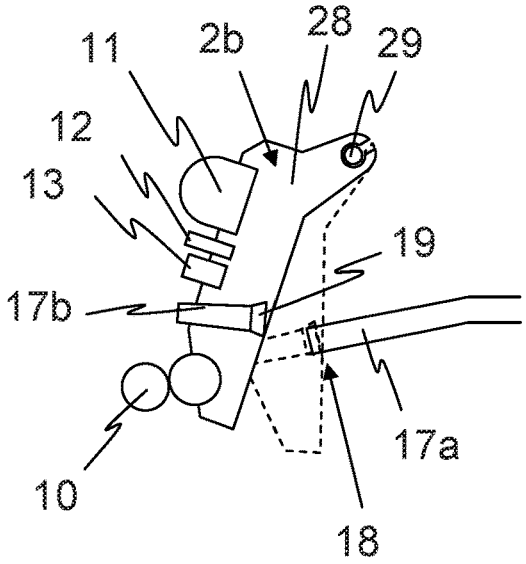
FIG. 3 is a detail view of a thread storage element with a first thread storage section and a second thread storage section.

In order to facilitate the joining of the two thread storage sections 17*a*, 17*b* at the separation point 18, it is advantageous if at least one of the two thread storage sections 17*a*, 17*b* has an extension 19 on its end turned towards the other thread storage section 17*a*, 17*b*. This is illustrated in FIG. 3. In the present case, the thread storage section 17*b* features a funnel-shaped extension 19 on its end turned towards the thread storage section 17*a*. This ensures that, despite the pivoting movement, the two thread storage sections 17*a*, 17*b* can be reliably combined. Alternatively or in addition, it would of course also be possible for the other thread storage section, in this case the thread storage section 17*a*, to feature a corresponding reduction 22 (see also FIG. 4) at its end turned towards the thread storage section 17*b*. Of course, the reduction 22 or the extension 19 could also be arranged at the other thread storage section 17*a*, 17*b* respectively.

Figure 4:
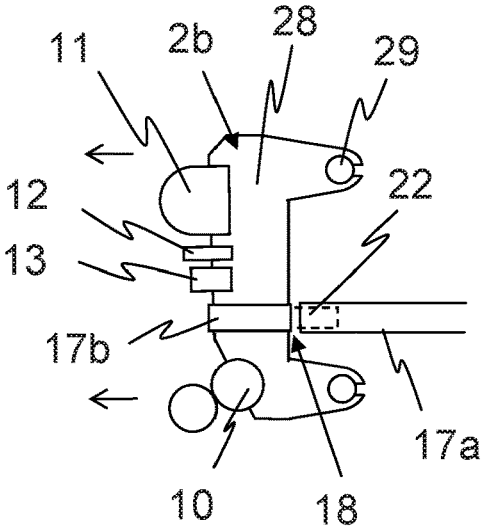
FIG. 4 is a schematic view of a thread storage element with a first thread storage section and a second thread storage section according to an alternative design.

FIG. 4 shows another design of a work station 2 with a first work station part 2*a* and a second work station part 2*b*, whereas, however, the second work station part 2*b* is movable in a linear manner relative to the first work station part 2*a*, as symbolized by the arrows. In the present case, the second thread storage section 17*b* features a reduction 22, which enables a telescopic interlocking of the two thread storage sections 17*a*, 17*b*.

Figure 5:
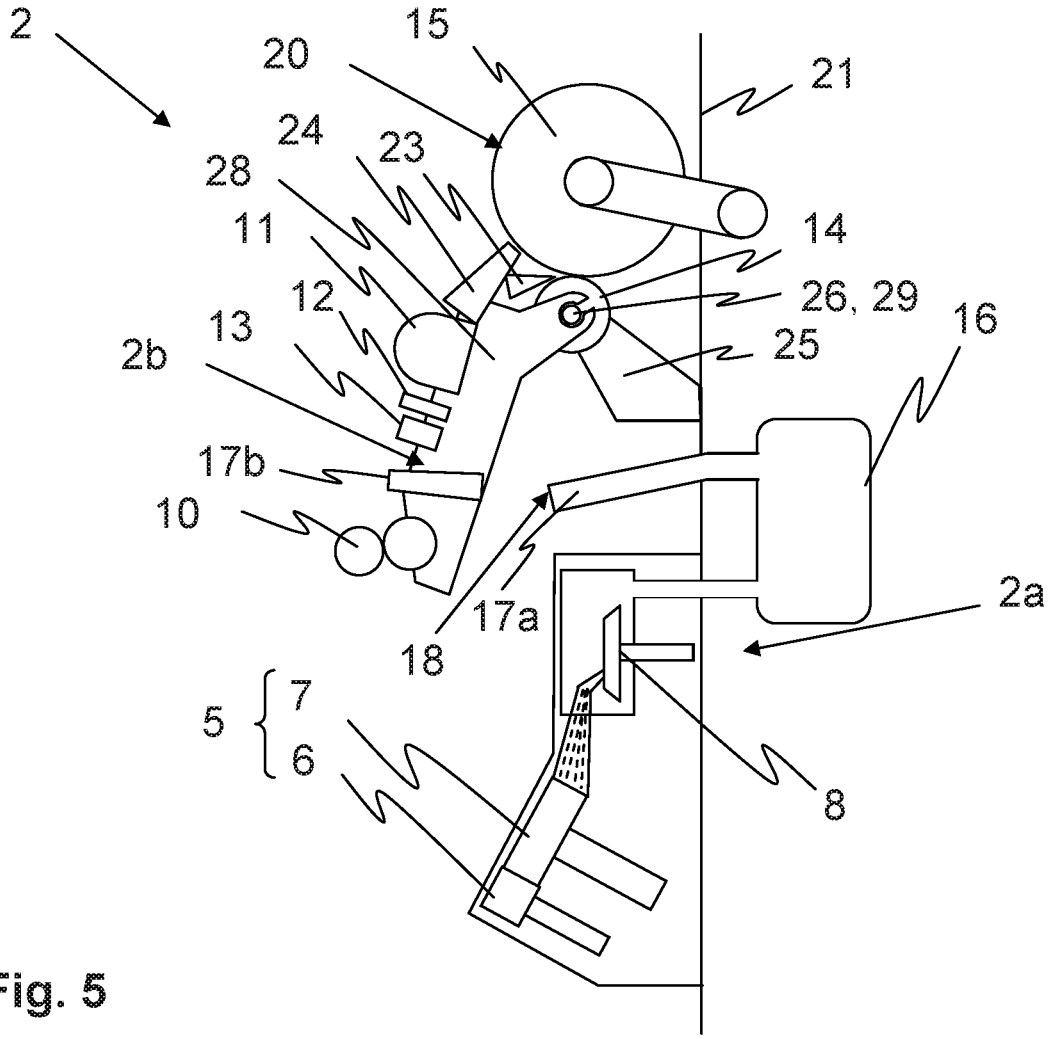
FIG. 5 is a schematic sectional view of a work station of a textile machine with a pivoted, second work station part in an additional design.

Finally, FIG. 5 shows another design of a work station 2 with a first work station part 2*a* and a second work station part 2*b*, with which, however, the first work station part 2*a* does not feature a first carrier element 27; rather, the fiber-guiding work elements of the first group are respectively arranged at the work station 2, individually or grouped together in smaller groups. In the present case, for example, the winding roller 14 is fastened to the work station 2 by means of its bracket 25, and the second work station part 2*b* is also fastened, in a pivotable and/or removable manner, to the work station 2, likewise by means of the bracket 25. On the other hand, the first thread storage section 17*a* is fastened individually to the work station 2 or here to the frame section 21. The thread-producing work elements 5, 6, 7, 8 are combined into a spinning box and thus fastened together to the frame section 21.

The invention is not limited to the illustrated embodiments. For example, it is not absolutely necessary for both thread storage sections 17*a*, 17*b* to be completely detached from one another at the separation point 18. Depending on the design of the two work station parts 2*a*, 2*b*, it would also be conceivable that the first thread storage section 17*a* and the second thread storage section 17*b* can only be moved relative to one another, but remain at least loosely connected or connected to each other by means of a swivel joint. In addition, both the work station 2 and the thread storage element 17 could feature not only a two-part structure, but also a multi-part structure. Likewise, numerous modifications are possible with respect to the designs and arrangements of the fiber-guiding and thread-producing work elements that are shown. The same applies to the arrangement of the individual work elements 5, 6, 7, 8, 10, 11, 12, 14, 17, 23, 24, which could also be fastened to a multiple number of first carrier elements 27 or a multiple number of second carrier elements 28 or could also be fastened to one another at least partially without carrier elements 27, 28 or, at least in the case of the first work station part 2*a*, also individually and directly at the frame section 21.

Additional variations and combinations within the framework of the claims also fall under the invention.

LIST OF REFERENCE SIGNS

1 Textile machine
2 Work station
2*a* First work station part
2*b* Second work station part
3 Storage container
4 Fiber material
5 Feed device
6 Feed roller
7 Opening device
8 Spinning element
9 Thread
10 Draw-off device
11 Waxing device
12 Yarn monitoring device
13 Device for thread tension compensation
14 Winding roller
15 Cross-wound bobbin
16 Negative pressure channel
17 Pneumatic thread storage element
17*a* First thread storage section
17*b* Second thread storage section
18 Separation point
19 Extension
20 Winding device
21 Frame section
22 Reduction
23 Traversing device
24 Suction nozzle
25 Bracket
26 Rotational axis
27 First carrier element
28 Second carrier element
29 Pivot axis

The invention claimed is:

1. A work station of a textile machine, comprising:

a plurality of fiber-guiding work elements that handle or process fibers in the form of fiber material or thread;

a first work station part on which a first group of the plurality of fiber-guiding work elements is arranged;

a second work station part on which a second group of the plurality of fiber-guiding work elements is arranged; and wherein the second work station part is arranged at the first work station part in a movable manner relative to the first work station part.

2. The work station of a textile machine according to claim 1, wherein the second work station part is arranged in a pivotable manner at the first work station part.

3. The work station of a textile machine according to claim 2, wherein the first group of fiber-guiding work elements comprises a winding roller arranged by a bracket at the first work station part, the second work station part pivotally mounted to the bracket.

4. The work station of a textile machine according to claim 1, wherein the first work station part comprises a first carrier element on which at least one or more of the first group of fiber-guiding work elements are arranged.

5. The work station of a textile machine according to claim 4, wherein the second work station part comprises a second carrier element on which at least one or more of the second group of fiber-guiding work elements are arranged.

6. The work station of a textile machine according to claim 1, further comprising a plurality of thread-producing work elements arranged at the first work station part.

7. The work station of a textile machine according to claim 1, wherein the plurality of fiber-guiding work elements comprises a pneumatic thread storage element for the temporary receiving of a thread, the pneumatic thread storage element comprising a multi-part structure with a first thread storage section and a second thread storage section connected to one another at a separation point.

8. The work station of a textile machine according to claim 7, wherein the first thread storage section is arranged at the first work station part and the second thread storage section is arranged at the second work station part.

9. A textile machine comprising at least one work station according to claim 1.

10. A pneumatic thread storage element for a work station of a textile machine for the temporary receiving of a thread, comprising a multi-part structure with a first thread storage section and a second thread storage section, the first thread storage section connected to the second thread storage section at a separation point.

11. The thread storage element according to claim 10, wherein the first thread storage section and the second thread storage section are connected in a pivotable manner at the separation point.

12. The thread storage element according to claim 10, wherein the first thread storage section is also detachable from the second thread storage section at the separation point.

13. The thread storage element according to claim 10, wherein one of the first thread storage section or the second thread storage section comprises an extension at an end turned towards the other respective thread storage section, or wherein one of the first thread storage section or the second thread storage section comprises a reduction at an end turned towards the other respective thread storage section.

14. A textile machine with at least one work station comprising a thread storage element in accordance with claim 10.

15. The work station of a textile machine according to claim 1, wherein the second work station part is arranged in a removable manner at the first work station part.

* * * * *